US007504002B2

(12) United States Patent
Brelsford et al.

(10) Patent No.: US 7,504,002 B2
(45) Date of Patent: Mar. 17, 2009

(54) METHOD OF PRODUCING COATED PAPER WITH REDUCED GLOSS MOTTLE

(75) Inventors: Gregg Lee Brelsford, Paducah, KY (US); Steven Paul Metzler, Chillicothe, OH (US); Stephen Craig Petro, Paducah, KY (US); Stig Renvall, Järvenpää (FI); Susanne Lynn Sowers, Dublin, OH (US)

(73) Assignee: Newpage Corporation, Dayton, OH (US)

( * ) Notice: Subject to any disclaimer, the term of this patent is extended or adjusted under 35 U.S.C. 154(b) by 510 days.

(21) Appl. No.: 11/336,389

(22) Filed: Jan. 20, 2006

(65) Prior Publication Data

US 2007/0169902 A1 Jul. 26, 2007

(51) Int. Cl.
*D21F 3/02* (2006.01)

(52) U.S. Cl. ..... 162/205; 162/135; 162/136; 162/141; 427/361

(58) Field of Classification Search ..... 162/205, 162/135, 136, 141, 358.3; 427/361
See application file for complete search history.

(56) References Cited

U.S. PATENT DOCUMENTS

| | | | |
|---|---|---|---|
| 4,624,744 | A | 11/1986 | Vreeland |
| 4,670,102 | A | 6/1987 | Maurer et al. |
| 5,237,915 | A | 8/1993 | Rounsley |
| 5,318,670 | A | 6/1994 | Link et al. |
| 5,916,419 | A | 6/1999 | Nicholson et al. |
| 6,183,603 | B1 | 2/2001 | Nicholson et al. |
| 6,306,461 | B1 | 10/2001 | Leino et al. |
| 6,352,022 | B1 | 3/2002 | Lau et al. |
| 6,413,371 | B1 | 7/2002 | Ahonen et al. |
| 6,497,790 | B2 | 12/2002 | Mohan et al. |
| 6,531,183 | B1 | 3/2003 | Cason et al. |
| 2004/0089434 | A1 | 5/2004 | Koivukannas et al. |

FOREIGN PATENT DOCUMENTS

| | | |
|---|---|---|
| EP | 0730061 | 9/1996 |
| EP | 0919663 | 6/1999 |
| WO | 01/98585 | 12/2001 |
| WO | 03/064761 | 8/2003 |
| WO | 2005/071159 | 8/2005 |

OTHER PUBLICATIONS

Anon, "Gloss Sensor Complements Printing probe", Paper, Film & Foil Converter, vol. 65, No. 3, p. 36 (Mar. 1991).
Kipman, et al., "A New Method of Measuring Gloss Mottle and Micro-Gloss Using a Line-Scan CCD-Camera Based Imaging System," International Conference on Digital Printing Technologies, Fort Lauderdale, Florida, pp. 714-717 (Oct. 2001).
Lepoutre, et al., "Effect of pretreatment of LWC basestock on coated paper properties," Tappi Journal, pp. 66-70 (Dec. 1986).
Engström, "Precalendering and its effect on paper-coating interaction," Tappi Journal, pp. 117-122 (Aug. 1992).
Urscheler, et al., "Practical Study of Free Jet Application in Paper Coating", 1998 Tappi Coating/Papermakers Conference Proceedings, pp. 63-71 (May 1998).
Salminen et al., "The Influence of hydrophobicity and structure on the penetration of water into paper," Wochenbl. Papierfabr. 120, No. 14, pp. 572-574 (Jul. 1992).
Leino et al., "A New Board Coating Method", 1998 Coating/Papermakers Conference Proceedings, pp. 791-806 (May 1998).
TAPPI Test Method T 480 om-05 "Specular gloss of paper and paperboard at 75 degrees" (1990).
TAPPI Test Method T 653 om-03, "Specular gloss of paper and paperboard at 20 degrees" (2003).
PCT, International Preliminary Report on Patentability issued regarding International Application No. PCT/US2007/060199 (Jul. 31, 2008).

*Primary Examiner*—Mark Halpern
(74) *Attorney, Agent, or Firm*—Thompson Hine LLP

(57) ABSTRACT

A method of producing a coated paper having reduced gloss mottle and excellent smoothness includes the steps of calendering a base stock at a relatively high pressure in a first calendering step, coating at least one side of the calendered base stock and calendering the coated base stock at a relatively low pressure in a second calendering step.

22 Claims, No Drawings

METHOD OF PRODUCING COATED PAPER WITH REDUCED GLOSS MOTTLE

FIELD OF THE INVENTION

The present invention relates to a method of manufacturing a coated paper having reduced gloss mottle, and more particularly, to a method of producing heavy basis weight coated glossy or dull fine paper exhibiting excellent smoothness with minimal gloss mottle.

BACKGROUND OF THE INVENTION

The calendering process in paper making involves passing a paper web through a nip or nips formed between one or more pairs of rolls. The paper is thereby made denser or flattened to form a smoother surface while the thickness of the paper is reduced. The apparent density of the resulting web is calculated with Equation 1:

$$\text{Apparent Density} = \text{Basis Weight} \div \text{Caliper}. \quad (1)$$

Basis weight here is given in pounds per ream at standard TAPPI conditions (50% RH, 72° F.), where a ream equals 3300 $ft^2$ (500, 25"×38" sheets) and caliper is the paper thickness measured in thousandths of an inch (or caliper points). The term, bulk, is occasionally referred to, which is defined as the inverse of density. Paper making technology is constantly improving the ability to achieve uniform density.

The present invention addresses an undesirable coated paper surface property related to non-uniform density known in the art as gloss mottle. The term "gloss mottle" refers to variations in specular reflectance from the surface of the sheet. See, e.g., *Gloss Sensor Complements Printing Probe*, Pap. Film Foil Converter, Vol. 65, No. 3, March 1991, p. 36; P. Mehts, K. Johnson, and D. Wolin, *A New Method of Measuring Gloss Mottle and Micro-Gloss*, IS&T's NIP-17, International Conference on Digital Printing Technologies, Fort Lauderdale, Fla., October 2001; p. 714-717. The contents of these documents are hereby incorporated by reference. The measurement technique used here, described in a later section, is the Tobias Gloss Mottle test. (Tobias Mottle Tester, *Tobias Gloss Mottle Index*, Tobias Associates, Inc., Ivyland, Pa.) A critical factor related to the cause of gloss mottle is non-uniform fiber mass distribution in the sheet. Uniform fiber distribution becomes particularly difficult to achieve at higher basis weights. This is due to the natural tendency of pulp fibers to form fiber bundles or "flocs" which are harder to disperse as the basis weight increases. Generally, individual flocs are several millimeters across in the plane of the sheet and have small regions between them that contain somewhat less fiber. Some degree of "flocciness" is present in all papers and results in thickness variations on a relatively small scale. The paper maker must decide how best to expend resources to overcome this effect to improve quality.

High quality glossy coated papers are typically calendered both prior to and after the coating process. The first calendering step usually involves the use of one steel nip, but multiple steel nips or alternate steel and soft nips may also be used. The nip pressure typically ranges from about 7,000 psi to 16,000 psi. This step produces an apparent density for the base stock that ranges between about 11-15 lbs/ream per caliper point. Despite pre-calendering, the base sheet is still characterized by lower hills formed by flocs and valleys positioned between the flocs. In other words, the floc-scale roughness of the base sheet is improved only somewhat by crushing fiber bundles or flocs.

The subsequent coating process further improves the sheet surface. A particularly useful method for coating the base sheet is blade coating, which uses a blade to meter off excess applied coating while the coating is still in the wet state. The blade coating approach levels the surface by filling in valleys or low spots between flocs, but leaves a thinner amount of coating on top of the flocs or high spots. However, water absorption from the wet coating first expands the flocs. Although the blade coating processes fills in the surface roughness, the coating also typically shrinks upon drying such that the original contours of the sheet are still present to some extent. See, e.g., P. Lepoutre, W. Bichard, J. Skowronski, *TAPPI J.*, December 1986, p. 66-70; G. Engstrom, *TAPPI J.*, August 1992, p. 117-122; R. Urscheler, P. Salminen, *Practical Study of Free-Jet Application in Paper Coating,* 1998 *TAPPI Coating/Papermakers Conf. Proc.*, May 4, 1998, p. 63-72; P. Salminen, D. Eklund, *Wochenbl. Papierfabr.*, Vol. 120, No. 14, Jul. 31, 1992, p. 572-574; M. Leino, M. Veikkola, *A New Board Coating Method,* 1998 Coating/Papermakers Conf. Proc., May 4-6, 1998, p. 791-806; and U.S. Pat. No. 6,306,461 to Leino et al. The relevant disclosures of the foregoing materials are hereby incorporated by reference. Smoothness and gloss mottle improvements can also be facilitated by multiple coating passes, since subsequent blade coating steps level the low spots further, but still not completely. Moreover, the improvements in gloss mottle and smoothness associated with multiple coatings require the use of additional coaters and drying systems, which increase the overall material, energy, capital, and operating costs of the process. Increased material waste associated with multiple coaters stations can frequently result in a less efficient, overall process.

Contour coating application methods such as air-knife, metered size press, spray, and curtain coaters may also be used. Contour coating typically involves the application of a relatively uniform coating layer thickness that follows the original contour of the base sheet, but typically does not provide the smoothness that can be obtained with a blade coater. Therefore, although the roughness of the sheet is improved relative to the base stock, there is still room for improvement to both gloss mottle and smoothness.

In accordance with the typical finishing operation, the coated base sheet is passed through a supercalender or hot roll calender to impart the final product gloss and smoothness. Both calender types consist of nips formed between a steel roll and a soft roll. Hot roll calenders typically have one or two nips per sheet side. Supercalenders usually have several nips. The finishing step is typically performed at nip pressures from about 2500-8000 psi and the soft rolls are relatively hard (>86 Shore D). The conventional finishing processes result in some degree of paper and print gloss mottle since the influence of flocs is still present. The dense spots formed by flocs will receive more local pressure than the low spots between flocs. This non-uniformity thereby produces the gloss mottle as the product is densifed. The typical ratio between the base stock and finishing calender nip pressures is about 10 or less.

A relatively new finish calendering method involves the use of a shoe calender. A smooth, soft synthetic belt passes with the paper web between a hard, stationary element (shoe) and a heated steel roll. This arrangement provides for a much longer dwell time in the nip at low pressure to develop gloss and smoothness while preserving bulk. The process is gaining popularity in the manufacture of uncoated and coated one-side paperboard grades. The shoe calender yields very good results for gloss mottle, but surface smoothness on a fine scale customary of printing papers coated on both sides are not typically achieved without further refinements to the base paper.

Papers produced in accordance with conventional methods have a Tobias mottle index of about 550 or greater on a 60-1700 scale, where more visually perceived gloss mottle is associated with higher Tobias mottle values. The paper smoothness can be characterized with the Parker Print Surf (PPS-S10=soft backing, 10 kg) method. ISO 8791-4:1992, *Paper and Board—Determination of roughness/smoothness (air leak methods), Part 4: Print-surf.* The contents of which are hereby incorporated by reference. Tobias gloss mottle indices and PPS-S10 values for several commercial papers at basis weights above about 120 lbs/ream (3300 $ft^2$ basis) are shown in Table 1.

TABLE 1

Tobias Mottle Indices and PPS-S10 for Commercial Coated Papers.

| Sample | Basis Weight, lbs/3300 $ft^2$ | Density, lbs/ream per caliper point | Tobias Mottle Index | PPS-S10, microns |
|---|---|---|---|---|
| A | 124 | 16.7 | 879 | 1.8 |
| B | 124 | 17.2 | 1112 | 2.1 |
| C | 130 | 17.2 | 823 | 1.7 |
| D | 136 | 17.3 | 770 | 1.3 |
| E | 146 | 21.3 | 592 | 0.76 |
| F | 146 | 21.4 | 722 | 0.79 |
| G | 153 | 16.0 | 752 | 2.2 |
| H | 154 | 16.3 | 996 | 1.9 |
| I | 184 | 19.7 | 697 | 0.85 |

It is apparent from the foregoing that there exists a need in the art for a method of producing a coated paper having reduced gloss mottle. In accordance with certain aspects, the method may provide Tobias gloss mottle values measured on coated fine paper that are below about 600 and PPS-S10 values that are below about 1.2. Furthermore, a need exists for a method of manufacturing paper products that exhibit reduced gloss mottle and excellent smoothness with the potential to reduce coating material and energy costs.

SUMMARY OF THE INVENTION

The present invention provides a method of producing a coated paper having reduced gloss mottle and good smoothness. In accordance with certain embodiments of the present invention, the method enables producing a product that has similar smoothness and less gloss mottle than conventional multi-pass coated products.

In accordance with one aspect of the present invention, a method of producing a smooth coated paper having reduced gloss mottle comprises the steps of forming a base stock, calendering the base stock at an average nip pressure of at least about 18,000 psi in a first calendering step, coating at least one side of the base stock to form a coated base stock, and calendering the coated base stock at a nip pressure not exceeding about 3,000 psi with steel/soft nips where the soft rolls have a hardness below about 86 Shore D in a second calendering step.

In accordance with another aspect of the present invention, a method of treating a web of cellulose fibers to reduce gloss mottle is provided. The method in accordance with this aspect of the invention comprises calendering a web of cellulose fibers in a first calendering step, coating at least one side of the web with a coating composition to form a coated paper web, and calendering the coated paper web in a second calendering step. In accordance with certain aspects of the present invention, the method described herein results in a product having a TAPPI Method 480 (OM-90, Specular Gloss of Paper and Paperboard at 75 Degrees, 1990), 75° gloss value of at least about 45, a Tobias gloss mottle rating of no more than about 550, and a Parker Print Surf value of less than about 1.2 microns. In accordance with particular aspects of the present invention, the first calendering step involves calendering the paper web at a first average nip pressure and the second calendering step involves calendering the coated paper web at a second average nip pressure wherein the first step nip pressure is more than about 10 times greater than the second step nip pressure.

In accordance with certain embodiments of the present invention, the base stock or paper web may be pre-coated or sized prior to the first calendering step. The method of the present invention is believed to be particularly useful in the production of heavy weight, glossy or dull papers having a basis weight in a range of from about 100 lbs/ream to about 220 lbs/ream.

DETAILED DESCRIPTION OF THE INVENTION

The method of the present invention provides a paper product having reduced gloss mottle. As used herein, "paper product" includes all varieties of paper or paperboard materials. The term "gloss" refers to gloss as measured in accordance with TAPPI method 480 as determined at a 75° angle of reflectance in accordance with TAPPI Test Method T 480 om-90, *Specular Gloss of Paper and Paperboard at 75 Degrees,* 1990, the contents of which are hereby incorporated by reference. Glossy grades of coated papers typically have a gloss of from about 60 to about 90. Papers produced in accordance with certain aspects of the present invention typically have gloss values of at least about 55, more particularly of at least about 60, and in accordance with certain aspects of the invention at least about 70 and in some cases at least about 80. In accordance with other aspects of the invention, dull papers having reduced gloss mottle are produced. Dull papers have gloss values of less than about 55, more particularly less than about 50. Gloss mottle is measured in accordance with the Tobias mottle index as described in more detail below.

In the method of the present invention, a base stock is formed and then calendered. The "base stock" may be a dried web or sheet or material otherwise formed from a paper furnish comprised of wood pulp and, optionally, other additives. In accordance with a particular aspect of the invention, the pulp is comprised mainly of chemical pulp, but the furnish may contain, if desirable, other types of pulp including mechanical pulp, semi-chemical pulp, recycled pulp, pulp containing other natural fibers, synthetic fibers, and any combination thereof. The base stock may be of any suitable fiber combination having a uniform dispersion of cellulosic fibers alone or in combination with other fiber materials, such as natural or synthetic fiber materials. Examples of suitable substrates include previous coated or uncoated paper or paperboard stock of a weight ranging from about 80 lbs/ream to about 220 lbs/ream, more particularly from about 100 lbs/ream to about 200 lbs/ream.

As indicated above, the base stock may be pre-coated or sized prior to being calendered. In accordance with some embodiments of the present invention, a coating of about 2-8 lbs/ream, more particularly from about 2-4 lbs/ream may be applied to one or both sides of the web. This pre-coating process may reduce the absorption characteristics of the paper web as well as make the web more uniform and increase the surface smoothness of the web. Coating compositions that can be applied in this optional step are not particularly limited. By way of example, the coating may contain mineral pigments, a synthetic binder and a synthetic thickener. Furthermore, it may be desirable to include a non-stick agent as an additive in the coating composition to suppress sticking to the calender roll during subsequent calendering operations. Moreover, if any of the calender rolls in the subsequent calendering operations are heated, the coating composition in general and the synthetic binder in particular should be chosen to be compatible with the operating temperature of the heated roll. The pre-coat composition can be applied in accordance with conventional coating techniques. Examples of particularly useful coating methods include film coating, blade coating and other such coating devices. In accordance with particular aspects of the present invention, starch surface sizing may be applied to the web prior to calendering.

The base stock is then calendered in a first calendering step at an average nip pressure of at least about 18,000 psi, more particularly of at least about 20,000 psi and in accordance with certain embodiments of at least about 22,000 psi. From a practical standpoint, the upper limit is around 35,000 to 40,000 psi. In accordance with one embodiment, the calender may be equipped with from 1 to about 5 nips, more particularly from 1 to 3 nips, each nip being formed between a pair of rolls. The rolls may be either hard or soft rolls. Hard rolls may typically have an outer surface formed of chilled iron, steel or other non-corrosive non-yielding conductive material that may be heated or chilled. The soft rolls may be surfaced with a polymer coating, fiber or other pliable material. Hard rolls typically have a surface hardness of greater than about 50 measured by the Rockwell C method. ASTM E18-03, *Standard Test Method for Rockwell Hardness and Rockwell Superficial Hardness of Metallic Materials*, ASTM International, Jun. 10, 2003. Soft rolls typically have a surface hardness of less than or equal to about 94 Shore D. ASTM D2240, *Standard Method for Rubber Property-Durometer Hardness*, ASTM International, Aug. 15, 2005. As a result of the higher pressures utilized in this first calendering step, the calender rolls are typically hard rolls and, more specifically, typically steel rolls. The term "average nip pressure" as used herein refers to the average pressure (force per area) developed in the nip between two rolls under a given load (force per lineal length) as calculated in accordance with conventional techniques. More specifically, the average nip pressure may be calculated by the Hertz equations as described in D. Roisum, *The Mechanics of Winding*, TAPPI Press, Atlanta, Ga., 1994, the contents of which are hereby incorporated by reference. The classical Hertzian contact theory is used to calculate the nip width between two cylinders as the following equation:

$$W = 2\left[\frac{2L}{\pi}\frac{D_1 D_2}{(D_1 + D_2)}\left(\frac{1-\upsilon_1^2}{E_1} + \frac{1-\upsilon_2^2}{E_2}\right)\right]^{0.5} \quad (2)$$

where

W=Nip Width

L=Applied Nip Load $D_1$, $D_2$=Roll Diameters $\nu_1$, $\nu_2$=Poisson ratios $E_1$, $E_2$=Young's moduli Subsequently, the average pressure in the nip is simply the applied load divided by the nip width:

$$P_{avg}=L/W \quad (3)$$

A sample calculation may be done using the following values for the equation variables:

L=1000 pli, $D_1$=33.9 in, $D_2$=16.9 in, $\nu_1=\nu_2$=0.35, $E_1$=210 GPa, $E_2$=0.527 GPa W=0.585 in =14.33 mm $P_{avg}$=1771 psi=12.2 MPa Moisture of the base sheet during the first calendering step is not particularly limited. Typically, the moisture of the base sheet will range between about 2% and 10% and in accordance with certain embodiments may range from about 3% to about 7% during the first calendering step.

The first calendering step preferably results in a base sheet having a density of at least about 15 lbs/ream per caliper point, more particularly a density of from about 15 to about 20 lbs/ream per caliper point and in accordance with certain embodiments, a density of from about 15.5 to about 18.5 lbs/ream per caliper point. Density values obtainable by the present invention are not limited to the recited values.

The first calendering step results in a base sheet having a smoothness value considerably smoother than that of base sheets produced in accordance with a conventional process. PPS-S10 values for the base sheet after subjecting the base sheet to the first calendering step typically range from about 2 to about 5 microns, more particularly from about 3 to about 4 microns. Specific values outside these ranges may be also produced in accordance with the present invention and still obtain the benefits associated with the invention.

The calendered base sheet is then coated on at least one side with a coating composition to form a coated base stock. The types of coating or coatings to be applied to the base stock are not particularly limited but are formulated and applied in consideration of the specific end use application of the coated paper. Examples of specific end use applications include, but are not limited to, web offset or sheet fed offset lithography, rotogravure, ink jet, flexography, etc. Conventional coatings may be applied to one or both sides of the base stock in accordance with conventional techniques including, but not limited to, bar or rod coating, air-knife or doctor blade coating, roll coating, spray coating, flooding or any combination thereof. The coating formulation is preferably applied to at least one side of the base stock using a blade coater, in a substantially uniform thickness over the surface of the base stock. The coating formulation typically is applied at a dry coat weight of from about 2 lbs/ream to about 12 lbs/ream per side, more particular from about 6 lbs/ream to about 10 lbs/ream per side and in accordance with certain embodiments from about 7 lbs/ream to about 9 lbs/ream per side. The coating formulation may be applied as a single layer alone, or in multiple layers, or as the final surface layer atop one or more other coating layers. In accordance with particular aspects of the present invention, the coated base sheet comprises a single layer alone. A single coated sheet may still be precoated and considered a single coated sheet.

Conventional coatings may include binders, mineral pigments, such as calcium carbonate and clay, solid or vacuolated synthetic pigments, glossing additives, and additives such as dispersants, shade modifying agents and rheology modifiers.

The coated base stock is then calendered at a nip pressure not exceeding about 3000 psi in a second calendering step. The lower nip pressure provides an acceptable gloss mottle level for high basis weight, single coated papers. In accordance with one aspect of the present invention, low nip pressure may be achieved by utilizing a calender including a hard roll and one or more soft rolls forming one or more nips. In this case the hardness of the soft roll would typically be 86 Shore D or less. The steel roll is used at a temperature ranging from about 100° F. to about 400° F. depending on the desired finish (dull, semi-gloss, gloss or high gloss). Other calender devices may also be used provided they are capable of calendering the paper at the lower nip pressure set forth herein. For example, extended nip calenders, such as shoe calenders and belt calenders, could be used in the second calendering step. The specific calender stack configuration is not particularly limited so long as the average nip pressure is no more than about 3000 psi, more particularly no more than about 2500 psi, and in accordance with certain embodiments no more than about 2000 psi. Pressures as low as about 100 psi or even lower may be used.

Typically, the moisture during the second calendering step is within the range of a conventional process, i.e., from about 3.5% to about 7.5% moisture.

The coated paper produced in accordance with certain aspects of the present invention typically has a Tobias mottle index of no more than about 600, more particularly no more than about 550 and, in accordance with certain embodiments, no more than about 400. The Tobias Gloss Mottle Index is measured with a Tobias Mottle Tester (MTI) produced by Tobias Associates, Inc., of Ivyland, Pa. The MTI evaluates gloss mottle by measuring the variation in specular gloss of an unprinted paper sample. The paper sample is mounted on a drum which rotates to carry it under the probe for measurement scans. The specular probe illuminates a 1.5 mm diameter circular area with a beam of light at a 45° angle. The reflected light at the matching opposite angle is measured and deviations at each measurement point from the averaged data of the scan are calculated. The Mottle Index is calculated by dividing the actual number of data points into the deviation curve area. A lower Mottle Index indicates a more homogeneous surface appearance. The MTI is capable of taking up to 20 scans of up to 500 averaged data points for each scan. Each data point is the average of a number, typically 64, of individual measurements of a single area of the sample.

The coated paper produced in accordance with certain aspects of the present invention may have a Parker Print Surf of no more than about 1.2 microns, more particularly no more than about 1.0 microns, and in accordance with certain embodiments, no more than about 0.8 microns.

In accordance with certain aspects of the present invention, the coated paper has a basis weight and range of from about 80 lbs/ream to about 220 lbs/ream, more particularly from about 100 lbs/ream to about 200 lbs/ream and in accordance with certain embodiments from about 120 lbs/ream to about 180 lbs/ream. It should be appreciated that the benefits of the present invention are not limited to base papers or coated papers of any particular basis weight.

The coated paper, produced in accordance with certain aspects of the present invention, typically has a 75° TAPPI gloss level from about 60 to about 80, and in accordance with particular aspects of the present invention, from about 65 to about 75. The present invention can also be used to produce papers having a dull or semi-gloss finish that typically have gloss levels of from about 40 to about 50.

The coated paper produced in accordance with particular embodiments of the present invention may have a density of from about 15 to about 20 lbs/ream per caliper point and more particularly from about 15.5 to about 18.5 lbs/ream per caliper point.

The following examples are representative, but are in no way limiting as to the scope of the present invention.

EXAMPLES

Example 1

Test samples were prepared at basis weights between 120-150 lb/ream and the results are provided in Table 2. The values for gloss, PPS-S10, and mottle index are averages for readings made on top and bottom surfaces of the sheets. The samples prepared under the inventive conditions (Conditions 7-10), with and without a pre-coat, resulted in smooth papers (PPS-S10 less than 1.0 micron) and low mottle indices (Tobias mottle indices of less than 400). These conditions were produced with high base stock calender pressures and low finish calender pressures using soft rolls having a low Shore D hardness. The inventive conditions had at least 10 times higher base/finish calender pressure ratios. Also, the coated densities were comparable to the double-coated product alternative for producing an excellent surface. Paper produced in accordance with standard paper making conditions utilizing the customary harder soft calender rolls (i.e. lower base stock and low to high finishing pressures, respectively) had mottle indices greater than 700, similar to the commercial single and double-coated papers (Conditions 1, C, F). Papers produced utilizing high pressure base stock calendering with high pressure finishing had good smoothness, but exhibited more mottle (Conditions 3-6). Paper produced at typical low base stock calendering pressure and low pressure finishing with low Shore D hardness rolls had a rougher surface (Condition 2).

TABLE 2

Data on smoothness and gloss mottle for basis weight 120-150 lb/3300 ft

| | Calender Pressure | | Base/Finish | Base | Shore D | | Finished | PPS- | Tobias | |
|---|---|---|---|---|---|---|---|---|---|---|
| Condition | Base, psi | Finish, psi | Pressure Ratio | Density, lbs/ream/pt | Roll Hardness | Paper Gloss, % | Density, lbs/ream/pt | S10, μm | Mottle Index | Comments |
| 1 (comparative) | 12040 | 2872 | 4.2 | 14.3 | 92 | 77 | 16.6 | 1.3 | 805 | Control, single coat |
| 2 (comparative) | 12040 | 1771 | 6.8 | 14.1 | 67 | 76 | 16.5 | 1.5 | 501 | Single coat |
| 3 (comparative) | 29022 | 4813 | 6.0 | 16.2 | 92 | 75 | 18.0 | 0.80 | 650 | Single coat |
| 4 (comparative) | 29022 | 2872 | 10.1 | 16.9 | 92 | 81 | 18.7 | 0.95 | 735 | Single coat |
| 5 (comparative) | 29022 | 7109 | 4.1 | 16.2 | 92 | 78 | 19.3 | 0.92 | 567 | Single coat |
| 6 (comparative) | 29022 | 4049 | 7.2 | 17.0 | 86 | 78 | 18.4 | 1.0 | 580 | Single coat |

TABLE 2-continued

Data on smoothness and gloss mottle for basis weight 120-150 lb/3300 ft

| Condition | Calender Pressure Base, psi | Calender Pressure Finish, psi | Base/Finish Pressure Ratio | Base Density, lbs/ream/pt | Shore D Roll Hardness | Paper Gloss, % | Finished Density, lbs/ream/pt | PPS-S10, μm | Tobias Mottle Index | Comments |
|---|---|---|---|---|---|---|---|---|---|---|
| 7 (inventive) | 29022 | 1771 | 16.4 | 17.2 | 67 | 80 | 19.0 | 0.88 | 381 | Single coat |
| 8 (inventive) | 29022 | 2406 | 12.1 | 16.2 | 70 | 73 | 18.8 | 0.83 | 370 | Single coat |
| 9 (inventive) | 28194 | 1965 | 14 | 18.5 | 70 | 75 | 19.4 | 0.84 | 381 | Precoat, single coat |
| 10 (inventive) | 26249 | 1771 | 15 | 17.8 | 67 | 83 | 19.7 | 0.75 | 352 | Precoat, single coat |
| 11 (comparative) | 28194 | 4813 | 5.9 | 18.5 | 92 | 79 | 19.4 | 0.80 | 589 | Precoat, single coat |
| 12 (comparative) | 26249 | 2872 | 9.1 | 17.0 | 92 | 84 | 18.9 | 0.61 | 628 | Precoat, single coat |
| Table 1, C (comparative) | 14345 | 4591 | 3.1 | 14.3 | 92 | 80 | 17.2 | 1.7 | 823 | Commercial, single coat |
| Table 1, F (comparative) | 7471 | 5245 | 1.4 | 14.0 | 92 | 77 | 21.4 | 0.79 | 722 | Commerical, double coat |

Example 2

Test sample results for coated papers at basis weights between 150-200 lb/ream and commercial single and double-coated products are presented in Table 3. The values for gloss, PPS-S10, and mottle index are averages for readings made on top and bottom surfaces of the sheets. Test samples produced under the inventive conditions had PPS-S10 values less than 1.0 micron and mottle indices of less than 500 (Conditions 17-18), while test and commercial papers made under standard conditions had mottle indices greater than 650. The inventive conditions base/finish calender pressure ratios were greater than a factor of 10 and the finished densities were comparable to the double-coated alternative for producing an excellent surface. The single-coated commercial sample had the worst mottle index (>1000). Single-coated Conditions (13-16, H) had poorer smoothness (PPS-S10 greater than ~1.2 microns), while the double-coated commercial sample (I) had a PPS-S10 value of <1.0 micron.

What is claimed is:

1. A method of producing a coated paper having reduced gloss mottle comprising:

calendering a base stock at an average nip pressure of at least about 18,000 psi in a first calendering step;

coating at least one side of said base stock with a coating composition to form a coated base stock; and calendering said coated base stock at a nip pressure not exceeding about 3000 psi in a second calendering step.

2. The method of claim 1 further comprising the step of pre-coating or sizing the base stock prior to the first calendering step.

3. The method of claim 1 wherein said base stock is calendered to a density of at least about 15 lbs/ream per caliper point.

4. The method of claim 3 wherein said base stock is calendered to a density of from about 15.5 to about 18.5 lbs/ream per caliper point.

TABLE 3

Data on smoothness and gloss mottle for basis weight 150-190 lb/3300 ft

| Condition | Calender Pressure Base, psi | Calender Pressure Finish psi | Base/Finish Pressure Ratio | Base Density, lbs/ream/pt | Shore D Roll Hardness | Paper Gloss, % | Finished Density, lbs/ream/pt | PPS-S10, μm | Tobias Mottle Index | Comments |
|---|---|---|---|---|---|---|---|---|---|---|
| 13 (comparative) | 14428 | 4225 | 3.4 | 14.0 | 92 | 69 | 16.3 | 1.9 | 1076 | Control, single coat |
| 14 (comparative) | 14428 | 1771 | 8.1 | 14.0 | 67 | 62 | 15.8 | 2.0 | 684 | Single coat |
| 15 (comparative) | 14428 | 2020 | 7.1 | 14.0 | 67 | 68 | 15.9 | 1.8 | 710 | Single coat |
| 16 (comparative) | 21800 | 4225 | 7.0 | 18.5 | 92 | 79 | 18.6 | 1.2 | 819 | Single coat |
| 17 (inventive) | 21800 | 1771 | 17 | 18.5 | 67 | 72 | 19.0 | 0.97 | 461 | Single coat |
| 18 (inventive) | 21800 | 2212 | 14.6 | 18.5 | 67 | 76 | 19.0 | 0.91 | 477 | Single coat |
| Table 1, H (comparative) | 14345 | 4355 | 3.3 | 14.2 | 92 | 74 | 16.3 | 1.9 | 996 | Commercial, single coat |
| Table 1, I (comparative) | 11610 | 5245 | 2.2 | 11.5 | 92 | 78 | 19.7 | 0.85 | 697 | Commercial, double coat |

5. The method of claim 1 wherein said base stock has a moisture content of from about 2 to 10 percent during the first calendering step.

6. The method of claim 1 wherein the first calendering step comprises passing the base stock through a calendering device comprising at least one nip formed between a pair of hard rolls.

7. The method of claim 6 wherein said hard rolls are steel rolls.

8. The method of claim 1 wherein the coated paper has a Tobias mottle index of no more than about 550.

9. The method of claim 1 wherein both sides of the base stock are coated.

10. The method of claim 1 wherein the coating composition is applied at a coat weight of from about 6 to about 12 lbs/ream (ream=3300 $ft^2$) based on the total dry weight of the coating composition.

11. The method of claim 1 wherein the second calendering step comprises passing the coated base stock through at least one nip formed between a hard roll and a soft roll.

12. The method of claim 11 wherein the soft roll has a hardness of less than about 86 Shore D.

13. The method of claim 1 wherein the second calendering step comprises calendering the coated base stock in a shoe calender.

14. The method of claim 1 wherein the coated paper has a basis weight in a range of from about 100 lbs/ream to about 220 lbs/ream.

15. The method of claim 1 further comprising forming a base stock from a plurality of cellulose fibers.

16. The method of claim 1 wherein the coated paper has a Parker Print Surf of less than about 1.2 microns.

17. The method of claim 16 wherein the coated paper has a Tobias mottle index of no more than about 550.

18. The method of claim 17 wherein the coated paper has a basis weight in a range of from about 100 lbs/ream to about 220 lbs/ream.

19. A method of treating a web of cellulose fibers to reduce gloss mottle comprising:

calendering a web of cellulose fibers in a first calendering step at a first average nip pressure to a density of at least about 15 lbs/ream per caliper point;

coating at least one side of the web with a coating composition to form a coated paper web; and calendering said coated paper web in a second calendering step at a second average nip pressure wherein said first average nip pressure is greater than said second average nip pressure to form a product having a gloss value of at least about 45, a Tobias gloss mottle rating of no more than about 550 and a Parker Print Surf of less than about 1.2 microns.

20. The method of claim 19 wherein said first average nip pressure is at least about 10 times said second average nip pressure.

21. The method of claim 20 wherein said second average nip pressure is less than about 3000 psi.

22. The method of claim 19 wherein said first average nip pressure is at least about 18,000 psi.

* * * * *